US010656582B2

(12) United States Patent
Goto et al.

(10) Patent No.: US 10,656,582 B2
(45) Date of Patent: May 19, 2020

(54) IMAGE FORMING APPARATUS, NON-TRANSITORY COMPUTER READABLE MEDIUM, AND TEST CHART

(71) Applicant: FUJI XEROX CO., LTD., Tokyo (JP)

(72) Inventors: Osamu Goto, Kanagawa (JP); Yoshiki Matsuzaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/133,725

(22) Filed: Sep. 18, 2018

(65) Prior Publication Data

US 2019/0187600 A1 Jun. 20, 2019

(30) Foreign Application Priority Data

Dec. 15, 2017 (JP) ..... 2017-240280

(51) Int. Cl.
*G03G 15/00* (2006.01)
*G03G 15/01* (2006.01)

(52) U.S. Cl.
CPC ..... *G03G 15/5058* (2013.01); *G03G 15/0121* (2013.01); *G03G 15/5062* (2013.01); *G03G 15/6561* (2013.01); *G03G 2215/00021* (2013.01); *G03G 2215/0161* (2013.01)

(58) Field of Classification Search
CPC ..... G03G 15/0121; G03G 15/5058; G03G 15/5062; G03G 15/6561; G03G 2215/00021; G03G 2215/0161
See application file for complete search history.

(56) References Cited

U.S. PATENT DOCUMENTS

| | | | | |
|---|---|---|---|---|
| 8,867,946 | B2 | 10/2014 | Sobue | |
| 2011/0076045 | A1* | 3/2011 | Sobue | G03G 15/5062 399/81 |
| 2015/0177666 | A1* | 6/2015 | Numazu | B65H 18/026 399/397 |
| 2015/0177668 | A1* | 6/2015 | Numazu | G03G 15/6529 399/397 |
| 2016/0286081 | A1* | 9/2016 | Kimura | H04N 1/40087 |
| 2017/0111547 | A1* | 4/2017 | Otani | H04N 1/06 |
| 2019/0196380 | A1* | 6/2019 | Goto | G03G 15/5062 |

FOREIGN PATENT DOCUMENTS

| | | |
|---|---|---|
| JP | 2008023791 | 2/2008 |
| JP | 2011069980 | 4/2011 |

* cited by examiner

*Primary Examiner* — Francis C Gray
(74) *Attorney, Agent, or Firm* — JCIPRNET

(57) ABSTRACT

An image forming apparatus as a first apparatus includes an image forming unit that forms an image onto a recording medium, a memory that stores first and second information, and a correcting unit that corrects an image formation position by the image forming unit in accordance with the first or second information. The first information is for correcting misregistration between a print position in the first apparatus and a print position in a second image forming apparatus as a second apparatus when an image is formed by the first apparatus and an image is subsequently formed by the second apparatus. The second information is for correcting misregistration between the print positions in the second and first apparatuses when an image is formed by the first apparatus, an image is subsequently formed by the second apparatus, and then an image is formed by the first apparatus.

11 Claims, 16 Drawing Sheets

FIG. 5

| | VERTICAL DISPLACEMENT AMOUNT | HORIZONTAL DISPLACEMENT AMOUNT |
|---|---|---|
| FIRST CORRECTION PARAMETER | 0.7 mm | 1.3 mm |
| SECOND CORRECTION PARAMETER | -0.2 mm | 0.8 mm |

IMAGE FORMING APPARATUS, NON-TRANSITORY COMPUTER READABLE MEDIUM, AND TEST CHART

CROSS-REFERENCE TO RELATED APPLICATIONS

This application is based on and claims priority under 35 USC 119 from Japanese Patent Application No. 2017-240280 filed Dec. 15, 2017.

BACKGROUND

Technical Field

The present invention relates to image forming apparatuses, non-transitory computer readable media, and test charts.

SUMMARY

According to an aspect of the invention, there is provided an image forming apparatus including an image forming unit, a memory, and a correcting unit. The image forming unit forms an image onto a recording medium. The memory stores first correction information and second correction information. The first correction information is used for correcting misregistration between a print position in the image forming apparatus and a print position in a second image forming apparatus when an image is formed by the image forming apparatus and an image is subsequently formed by the second image forming apparatus. The second correction information is used for correcting misregistration between the print position in the second image forming apparatus and the print position in the image forming apparatus when an image is formed by the image forming apparatus, an image is subsequently formed by the second image forming apparatus, and then an image is formed by the image forming apparatus. The correcting unit corrects a position where the image is to be formed by the image forming unit in accordance with either the first correction information or the second correction information stored in the memory.

BRIEF DESCRIPTION OF THE DRAWINGS

Exemplary embodiments of the present invention will be described in detail based on the following figures, wherein:

FIG. 5 illustrates a specific example of correction parameters stored in a correction-parameter storage unit;

DETAILED DESCRIPTION

Exemplary embodiments of the present invention will now be described in detail with reference to the drawings.

Figure 1:
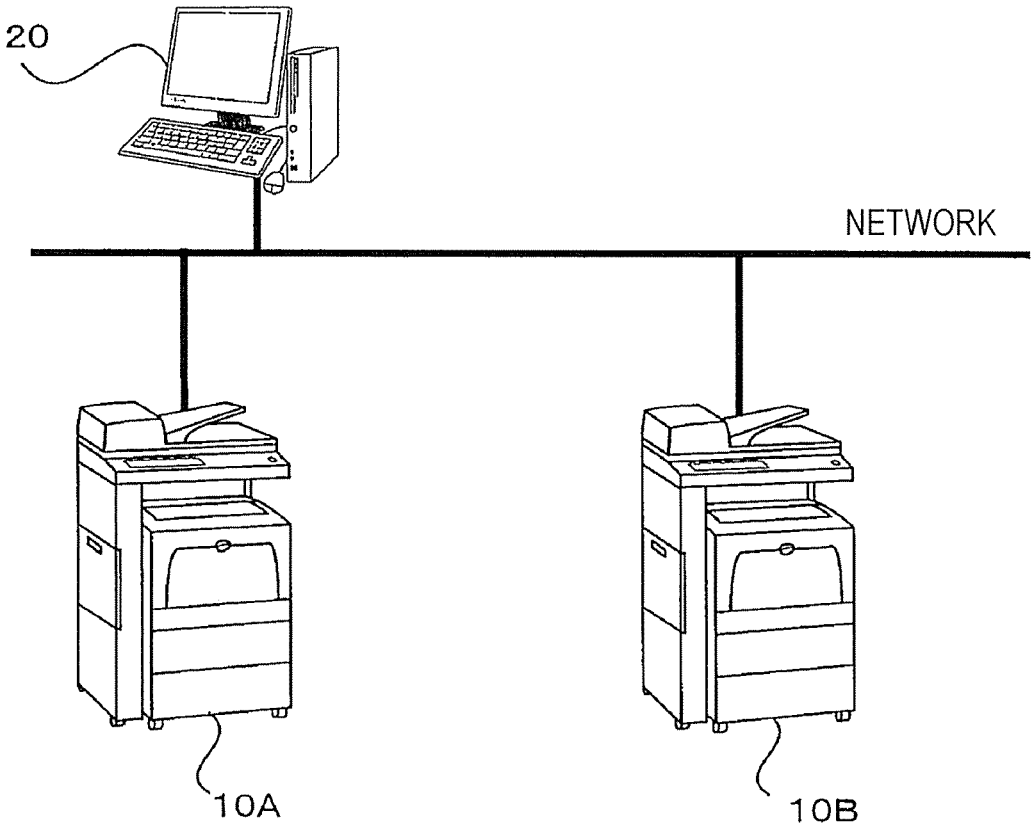
FIG. 1 illustrates a system configuration of a printing system according to an exemplary embodiment of the present invention.

FIG. 1 illustrates a system configuration of a printing system according to an exemplary embodiment of the present invention.

As shown in FIG. 1, the printing system according to the exemplary embodiment of the present invention includes two image forming apparatuses 10A and 10B and a terminal apparatus 20 that are connected to one another via a network.

The image forming apparatus 10B is a printer, that is, a so-called YMCK printer, capable of forming a process-color (YMCK) image constituted of yellow (Y), magenta (M), cyan (C), and black (K) colors onto a recording medium, such as a printing sheet.

The image forming apparatus 10A is a printer, that is, a so-called spot-color printer, capable of forming an image of a spot color other than the YMCK process colors onto a recording medium. A spot color includes various colors other than the YMCK colors, such as metallic luster colors, including silver (Si) and gold (G) colors, a white color (W), and a clear color. The following description with regard to this exemplary embodiment relates to a case where the image forming apparatus 10A is capable of forming images of three types of spot colors, namely, silver (Si), gold (G), and white (W) colors.

Furthermore, the image forming apparatus 10A is configured to form a black (K) image, which is a process-color image, in addition to the images of the three types of spot colors. The reason that the image forming apparatus 10A is configured in this manner will be described later.

In the printing system according to this exemplary embodiment, a printing sheet having an image formed thereon using one of the two image forming apparatuses 10A and 10B undergoes additional printing by printing another image thereon using the other image forming apparatus.

In particular, in this exemplary embodiment, when an image forming process is to be sequentially performed three times on the same printing sheet by alternately using the two image forming apparatuses 10A and 10B, a positional adjustment is performed for reducing misregistration between the print positions of the two image forming apparatuses 10A and 10B.

Figure 2:
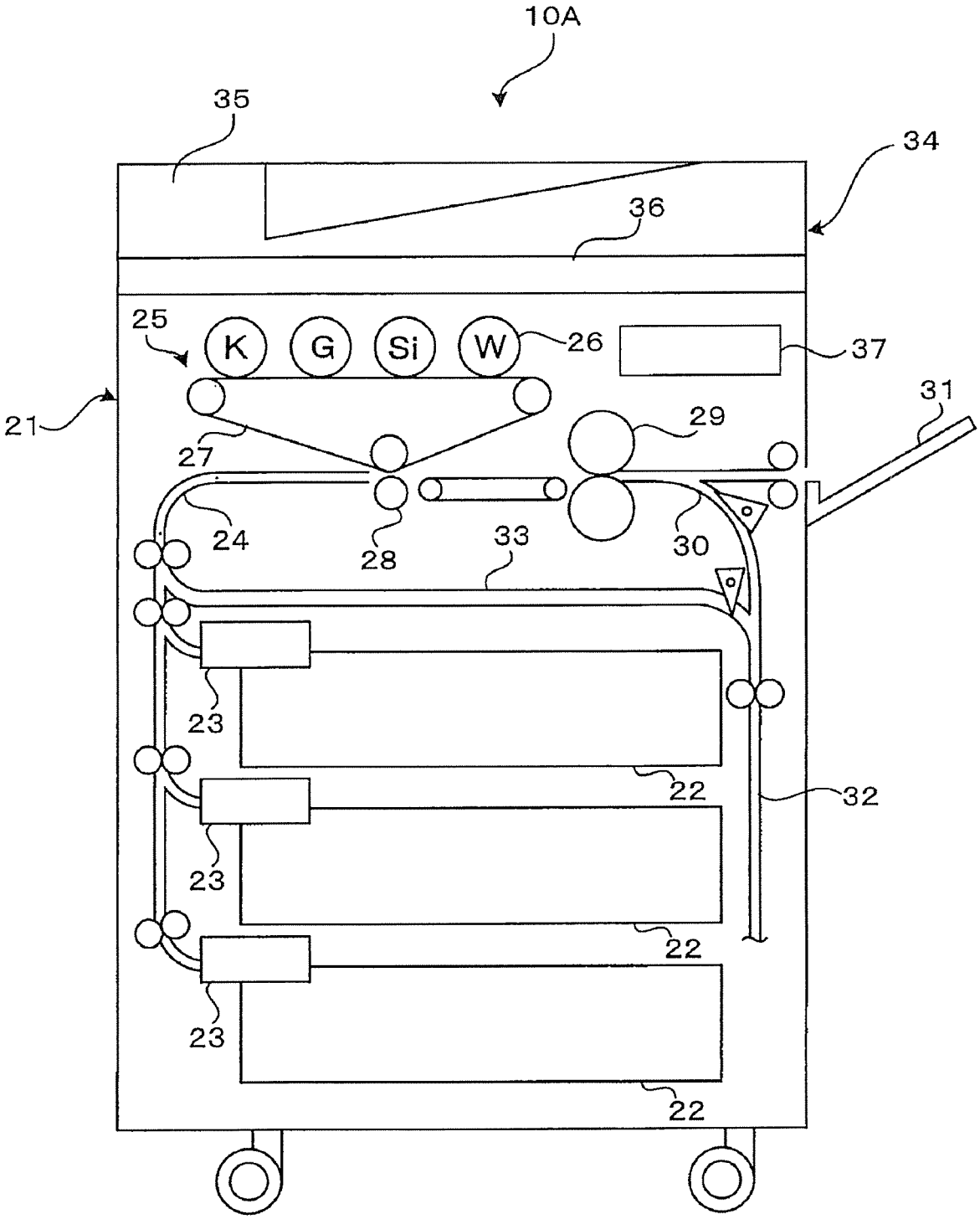
FIG. 2 is a cross-sectional view illustrating the structure of an image forming apparatus according to an exemplary embodiment of the present invention.

Next, the structure of the image forming apparatus 10A shown in FIG. 1 will be described with reference to FIG. 2. FIG. 2 is a cross-sectional view illustrating the structure of the image forming apparatus 10A according to this exemplary embodiment. The structure of the image forming apparatus 10B only differs from that of the image forming apparatus 10A in that the toners set therein are process-color toners, that is, YMCK toners, instead of spot-color toners. Therefore, a description regarding the structure of the image forming apparatus 10B will be omitted.

The image forming apparatus 10A has a printing device 21 and an image reading device 34. The printing device 21 has, for example, three recording-medium feed cassettes 22, and these recording-medium feed cassettes 22 are respectively provided with feed heads 23.

When one of the recording-medium feed cassettes 22 is selected, the feed head 23 is actuated so that a recording medium is fed from the selected recording-medium feed cassette 22 to an image forming section 25 via a recording-medium feed path 24.

The image forming section 25 is provided with white (W), silver (Si), gold (G), and black (K) photoconductors 26 arranged side-by-side, and is also provided with an intermediate transfer belt 27.

Each photoconductor 26 is surrounded by, for example, a charging device, an exposure device, a developing device, a first-transfer device, and a cleaning device (not shown), thereby constituting an image forming unit that forms an image for each color onto a recording medium. A toner image formed on each photoconductor 26 is transferred onto the intermediate transfer belt 27.

The toner images on the intermediate transfer belt 27 are transferred onto a transported recording medium by a second-transfer roller 28 and are fixed to the recording medium by a fixing device 29. The recording medium having the toner images fixed thereto is output to an output tray 31 via a recording-medium output path 30.

If duplex printing is set, the recording medium having the images fixed to the front face thereof by the fixing device 29 is transported from the recording-medium output path 30 to an inverting device 32. The recording medium is inverted by this inverting device 32, is transported to a recording-medium inverting path 33, is returned to the recording-medium feed path 24 again, and is transported to the image forming section 25 where printing is performed on the back face of the recording medium.

The image reading device 34 has an automatic document feeder 35 capable of reading both faces of a document. The document is transported to a platen 36 by the automatic document feeder 35, and an image of the document on the platen 36 is read by a reader constituted of, for example, a charge coupled device (CCD). The automatic document feeder 35 also serves as a platen cover. A document may be placed on the platen 36 by opening this platen cover. The opening and closing of the platen cover are detectable by a platen-cover open-close detector.

The image forming apparatus 10A is provided with a facsimile modem connected to a public line and a network communication device connected to a network, such as a local area network (LAN). By using the network communication device provided in the image forming apparatus 10A, an image read by the image reading device 34 is transmittable to a terminal connected to the network. By executing such a process, the image forming apparatus 10A also functions as a facsimile transmitter.

The image forming apparatus 10A is also provided with a controller 37 for controlling various components, such as the image forming section 25. The printing device 21 and the image reading device 34 perform, for example, a printing process and an image reading process based on control by the controller 37.

Figure 3:
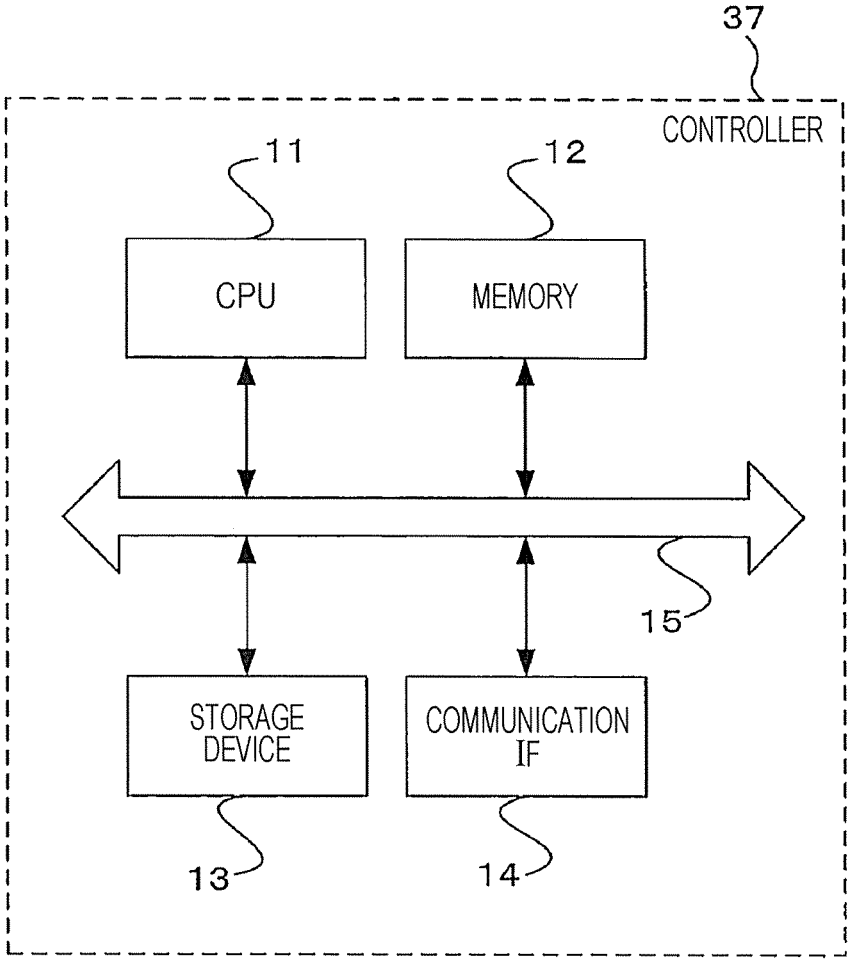
FIG. 3 illustrates a hardware configuration of a controller shown in FIG. 2.

FIG. 3 illustrates a hardware configuration of the controller 37.

As shown in FIG. 3, the controller 37 includes a central processing unit (CPU) 11, a memory 12, a storage device 13, such as a hard disk drive, and a communication interface (IF) 14 that transmits and receives data to and from an external apparatus via a network. These components are connected to one another via a control bus 15.

The CPU 11 executes a predetermined process based on a control program stored in the memory 12 or the storage device 13 so as to control the operation of the controller 37. Although the CPU 11 in this exemplary embodiment is configured to read and execute the control program stored in the memory 12 or the storage device 13, the program may be provided to the CPU 11 by being stored in a storage medium, such as a compact disc read-only memory (CD-ROM).

Figure 4:
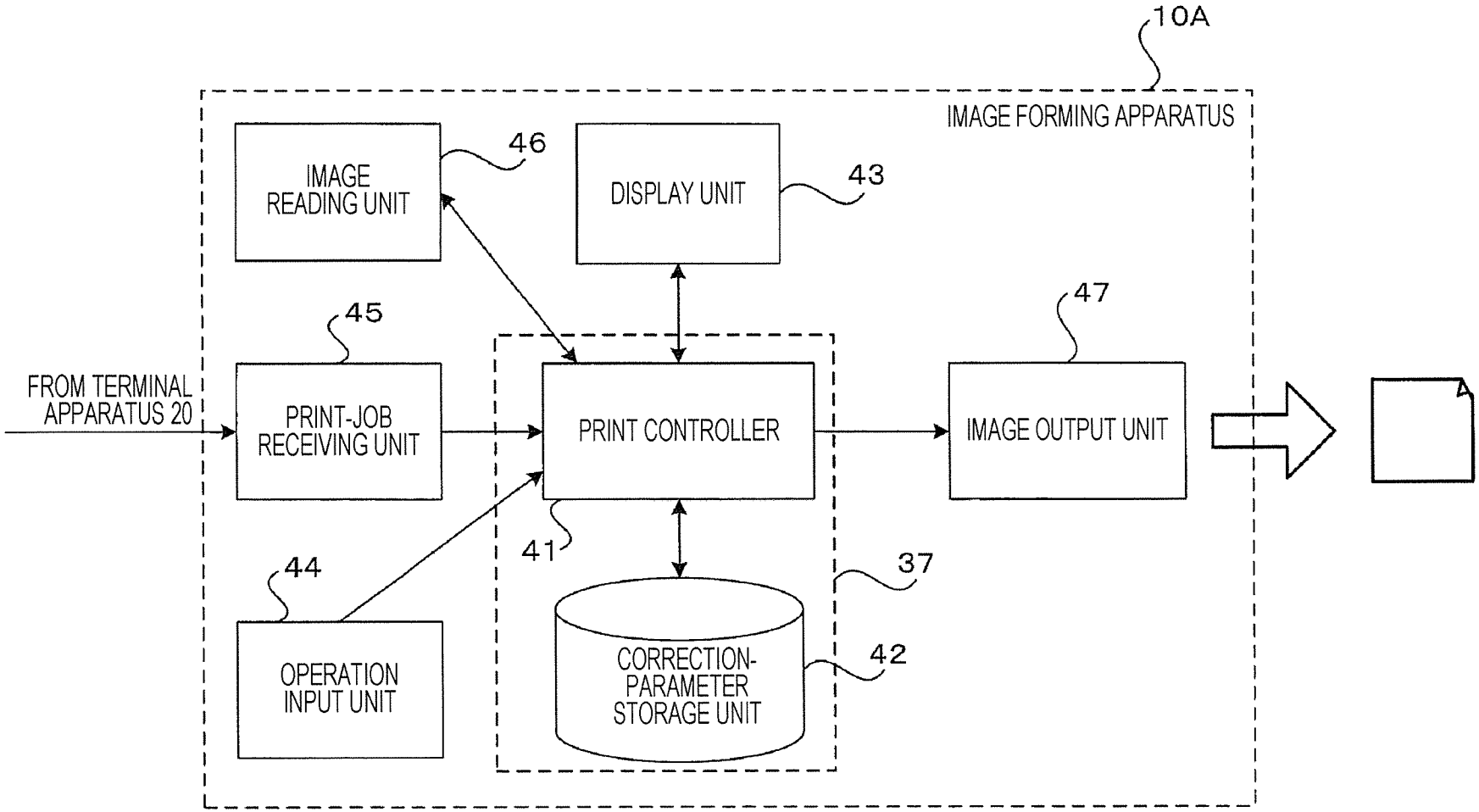
FIG. 4 is a block diagram illustrating a functional configuration of the entire image forming apparatus including the controller.

FIG. 4 is a block diagram illustrating a functional configuration of the entire image forming apparatus 10A including the controller 37 realized by executing the aforementioned control program.

As shown in FIG. 4, the image forming apparatus 10A according to this exemplary embodiment includes the controller 37, a display unit 43, an operation input unit 44, a print-job receiving unit 45, an image reading unit 46, and an image output unit 47. The controller 37 includes a print controller 41 and a correction-parameter storage unit 42.

The print-job receiving unit 45 receives a print job (i.e., a print command) transmitted from the terminal apparatus 20.

The print controller 41 performs control for generating print data based on the print job received by the print-job receiving unit 45 and for outputting the generated print data from the image output unit 47.

The display unit 43 is controlled by the controller 37 and displays various types of information to a user. The operation input unit 44 receives various types of operation information input by the user. The display unit 43 and the operation input unit 44 constitute a so-called operation panel.

Based on control by the print controller 41, the image output unit 47 outputs an image onto a recording medium, such as a printing sheet, having undergone various processes, such as charging, exposure, developing, transfer, and fixing processes.

When the image is to be formed on the recording medium at the image output unit 47, the correction-parameter storage unit 42 stores a correction parameter (correction information) used for correcting the image formation position, that is, the print position.

FIG. 5 illustrates a specific example of correction parameters stored in the correction-parameter storage unit 42. In the image forming apparatus 10A according to this exemplary embodiment, the correction-parameter storage unit 42 stores two pieces of correction information, namely, first and second correction parameters.

In order to simplify the description in this exemplary embodiment, each correction parameter includes two types of correction amounts, namely, a "vertical displacement amount" and a "horizontal displacement amount", as shown in FIG. 5. However, since actual print-position misregistration includes multiple misregistration components caused by various displacement amounts, the correction parameters may also include various correction amounts, such as a trapezoidal distortion amount, a vertical-parallelogram distortion amount, a horizontal-parallelogram distortion amount, vertical magnification, and horizontal magnification, in addition to the above correction amounts.

The first correction parameter is correction information used for correcting misregistration between the print position in the image forming apparatus 10A and the print position in the other image forming apparatus 10B when an image is formed by the image forming apparatus 10A and another image is subsequently formed by the other image forming apparatus 10B.

The second correction parameter is correction information used for correcting misregistration between the print position in the other image forming apparatus 10B and the print position in the image forming apparatus 10A when an image is formed by the image forming apparatus 10A, another image is subsequently formed by the other image forming apparatus 10B, and then another image is formed by the image forming apparatus 10A.

The print controller 41 corrects the image formation position of the image to be formed by the image forming units in the image output unit 47 in accordance with either the first correction parameter or the second correction parameter stored in the correction-parameter storage unit 42.

The reasons for correcting the print position by using the first and second correction parameters in this manner will be described below. The first and second correction parameters are used when additional printing is to be performed twice by performing a first step of using the image forming apparatus 10A to form an image including a spot color onto a printing sheet, a second step of using the image forming apparatus 10B to form an image of YMCK colors, which are process colors, and a third step of using the image forming apparatus 10A to form another image including a spot color.

A specific example where such additional printing is performed twice by using the image forming apparatuses 10A and 10B will be described below with reference to FIGS. 6 to 8.

Figure 6:
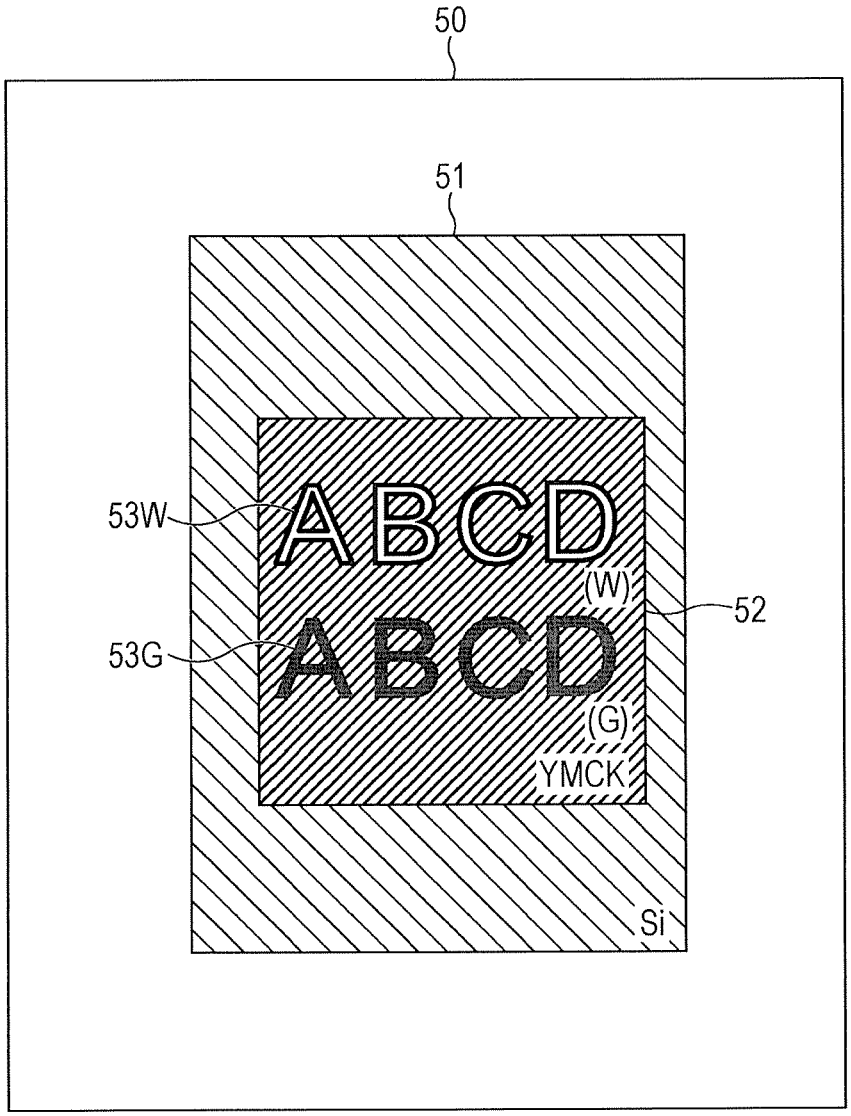
FIG. 6 illustrates an example of a print result in a case where additional printing is performed twice by first and second image forming apparatuses.

The following description relates to a case where a printing process for obtaining a print result shown in FIG. 6 is executed.

In the example of the print result shown in FIG. 6, a silver (Si) image 51 is formed on a white printing sheet 50, a YMCK image 52 is formed on the silver image 51, and a white (W) text image 53W and a gold (G) text image 53G are finally formed on the YMCK image 52.

Figure 7:
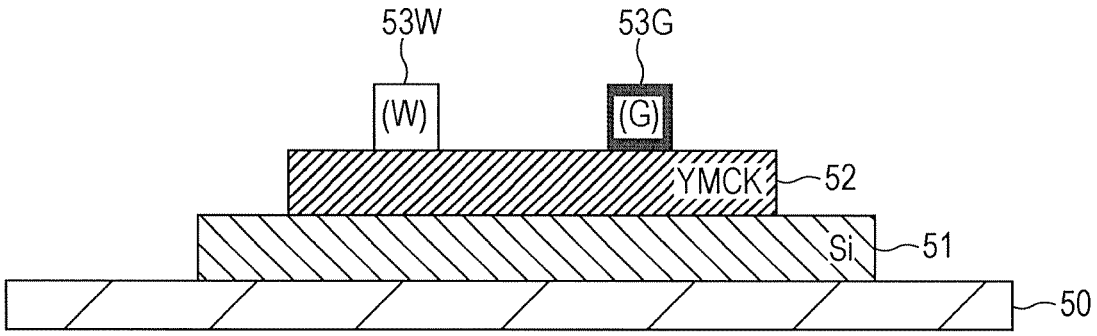
FIG. 7 is a cross-sectional view of the example of the print result shown in FIG. 6.

FIG. 7 is a cross-sectional view of the example of the print result shown in FIG. 6. In the cross-sectional view shown in FIG. 7, the silver (Si) image 51, the YMCK image 52, and the white (W) or gold (G) text image 53W or 53G are sequentially formed on the printing sheet 50.

In order to obtain the print result shown in FIGS. 6 and 7, it is necessary to perform the printing process three times by using the image forming apparatuses 10A and 10B. The printing sequence of this three-step printing process will be described below with reference to FIG. 8.

The first step involves forming the silver image 51 onto the printing sheet 50 by using the image forming apparatus 10A as a spot-color printer (first printing).

The second step involves forming the YMCK image 52 onto the printing sheet 50 having the silver image 51 formed thereon by using the image forming apparatus 10B as a YMCK printer.

The third step involves forming the white (W) and gold (G) text images 53W and 53G onto the printing sheet 50 having the YMCK image 52 formed thereon by using the image forming apparatus 10A as a spot-color printer (second printing).

Because a printing sheet contains moisture, the printing sheet passing through the fixing device undergoes a slight change in sheet size due to the moisture partially evaporating in accordance with heat. Thus, when an image is formed on the printing sheet in a certain image forming apparatus and another image is to be formed again on the printing sheet in another image forming apparatus, the print positions may sometimes deviate from each other. Therefore, in a case where images are to be formed on the same printing sheet 50 by using the two above-described image forming apparatuses 10A and 10B, the image formation positions have to be adjusted.

In particular, when performing the three-step printing process on the same printing sheet, which involves the first printing step of using the image forming apparatus 10A, the printing step of using the image forming apparatus 10B, and the second printing step of using the image forming apparatus 10A, as described above, a two-step positional adjustment process that involves a positional adjustment between the image forming apparatus 10A (first printing) and the image forming apparatus 10B and a positional adjustment between the image forming apparatus 10B and the image forming apparatus 10A (second printing) is necessary.

The reason for this is that, because moisture in a printing sheet evaporates every time the printing sheet undergoes a fixing process, the sheet size of the printing sheet slightly changes every time the printing sheet undergoes a fixing process, meaning that a positional adjustment is necessary for the number of times the printing sheet undergoes a fixing process.

Figure 8:
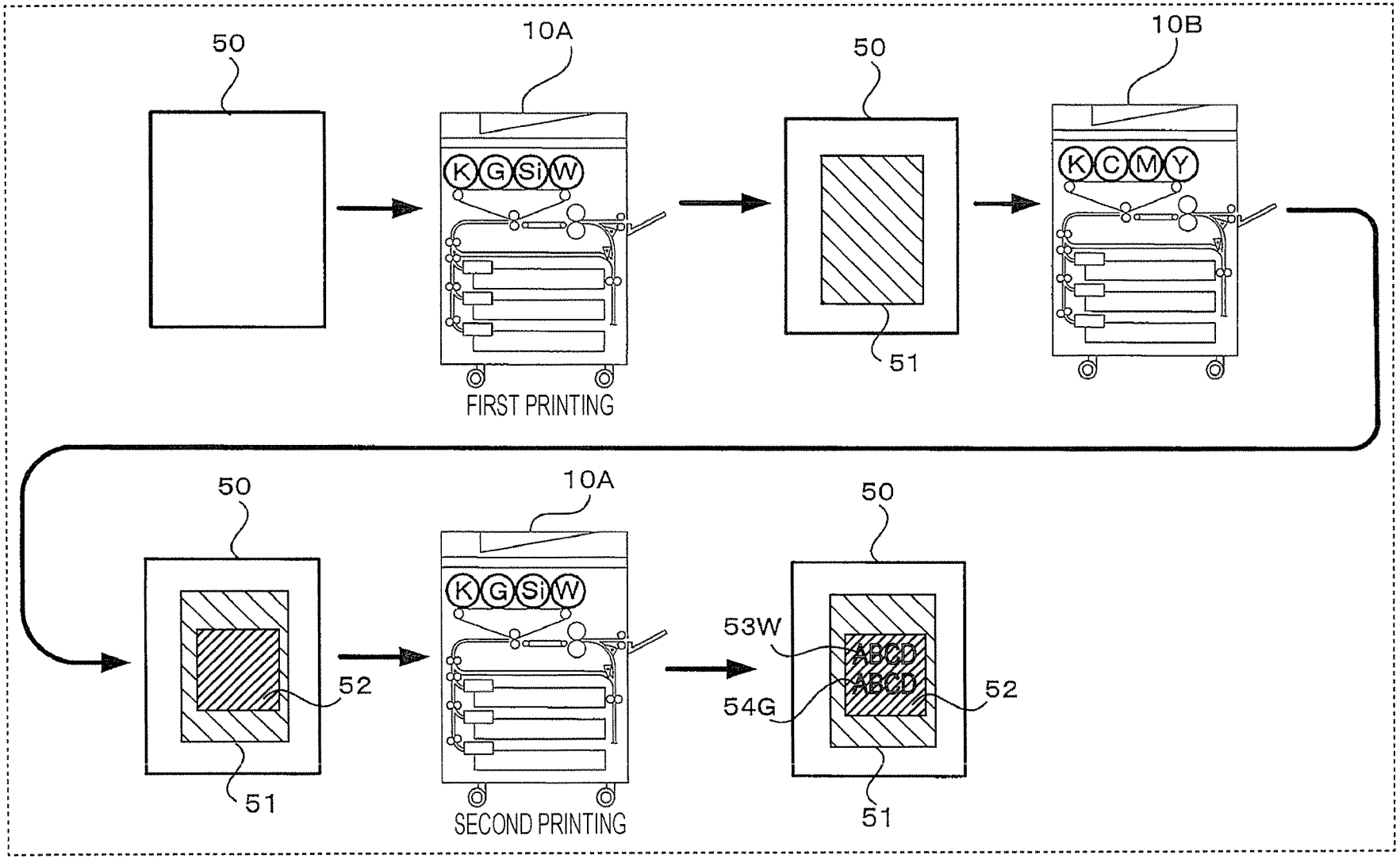
FIG. 8 illustrates a printing procedure in a case where a printing process is performed three times by using the first and second image forming apparatuses for obtaining the print result shown in FIGS. 6 and 7.

Specifically, in the sequence of the printing process shown in FIG. 8, the image forming apparatus 10A (first printing) forms an image onto the printing sheet 50 that has not undergone a fixing process, and the image forming apparatus 10B forms an image onto the printing sheet 50 that has undergone a single fixing process. Then, the image forming apparatus 10A (second printing) forms an image onto the printing sheet 50 that has undergone two fixing processes.

Therefore, the first correction parameter for correcting the print position between the silver image 51 formed by the image forming apparatus 10A (first printing) and the YMCK image 52 formed by the image forming apparatus 10B is generated and is stored in the correction-parameter storage unit 42.

Moreover, the second correction parameter for correcting the print position between the YMCK image 52 formed by the image forming apparatus 10B and the white and gold text images 53W and 53G formed by the image forming apparatus 10A (second printing) is generated and is stored in the correction-parameter storage unit 42.

Next, a method for generating these first and second correction parameters will be described.

The first correction parameter is generated by using a test chart obtained by forming a first test image (print-position-adjustment image) onto a printing sheet by using the image forming apparatus 10A and then forming a second test image onto the same printing sheet by using the image forming apparatus 10B.

The second correction parameter is generated by using a test chart obtained by forming an image with no print data onto a printing sheet by using the image forming apparatus 10A, forming a second test image onto the same printing sheet by using the image forming apparatus 10B, and then forming the first test image or a third test image different from the first test image onto the same printing sheet by using the image forming apparatus 10A.

When the image forming apparatus 10A is to form the image with no print data onto the printing sheet in the case where the second correction parameter is to be generated, the image forming apparatus 10A does not perform an image forming process on the printing sheet but executes a process involving a fixing process.

If the first and second correction parameters are to be generated simultaneously, the first and second correction parameters are generated by using a test chart obtained by forming a first test image onto a printing sheet by using the image forming apparatus 10A, forming a second test image onto the same printing sheet by using the image forming apparatus 10B, and then forming a third test image onto the same printing sheet by using the image forming apparatus 10A.

Specifically, this test chart is obtained by forming, on the printing sheet, the first test image formed by the image forming apparatus 10A, the second test image formed by the image forming apparatus 10B after the first test image is formed, and the third test image formed by the image forming apparatus 10A after the second test image is formed.

The first and second correction parameters are generated by the print controller 41 in the controller 37 and are stored in the correction-parameter storage unit 42.

Specifically, if the first and second correction parameters are to be generated simultaneously, the print controller 41 generates the first correction parameter from the positional relationship between the first test image and the second test image on the test chart, and generates the second correction parameter from the positional relationship between the second test image and the third test image on the test chart.

When the image forming apparatus 10A is to perform a printing process, the user designates which one of the two correction parameters is to be used for adjusting the print position.

Specifically, the operation input unit 44 receives the selected correction parameter to be used when the image forming units in the image output unit 47 are to form an image onto a printing sheet.

Then, the print controller 41 corrects the image formation position of the image to be formed by the image forming units in the image output unit 47 in accordance with the correction parameter selected from the first and second correction parameters and received by the operation input unit 44.

In the image forming apparatus 10A according to this exemplary embodiment, one of the four image forming units is capable of forming a K image, which is a process color image, onto a printing sheet. In a case where a test image is to be formed on a printing sheet, the test image is formed by using the K color that is readily detectable when the test image is printed on a white printing sheet.

Next, a specific method for generating the first and second correction parameters described above will be described in detail with reference to the drawings.

First, the following description with reference to FIGS. 9A to 12 relates to a case where the first and second correction parameters are generated from different test charts.

Figure 9A:
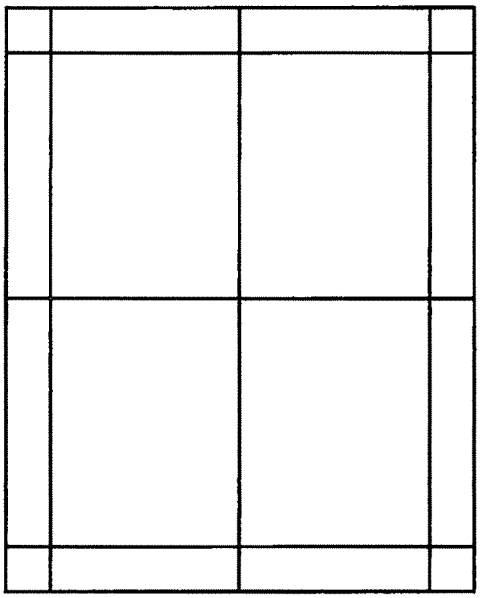
FIG. 9A illustrates an example of a test image printed in the first image forming apparatus.
Figure 9B:
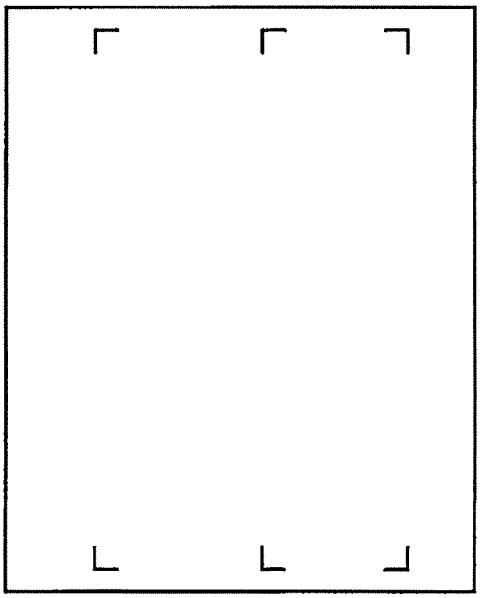
FIG. 9B illustrates an example of a test image printed in the second image forming apparatus.

FIG. 9A illustrates an example of a test image printed in the image forming apparatus 10A, and FIG. 9B illustrates an example of a test image printed in the image forming apparatus 10B. These test images may be stored and be printed in the image forming apparatuses 10A and 10B, or the terminal apparatus 20 may command the image forming apparatuses 10A and 10B to print such test images.

Figure 10:
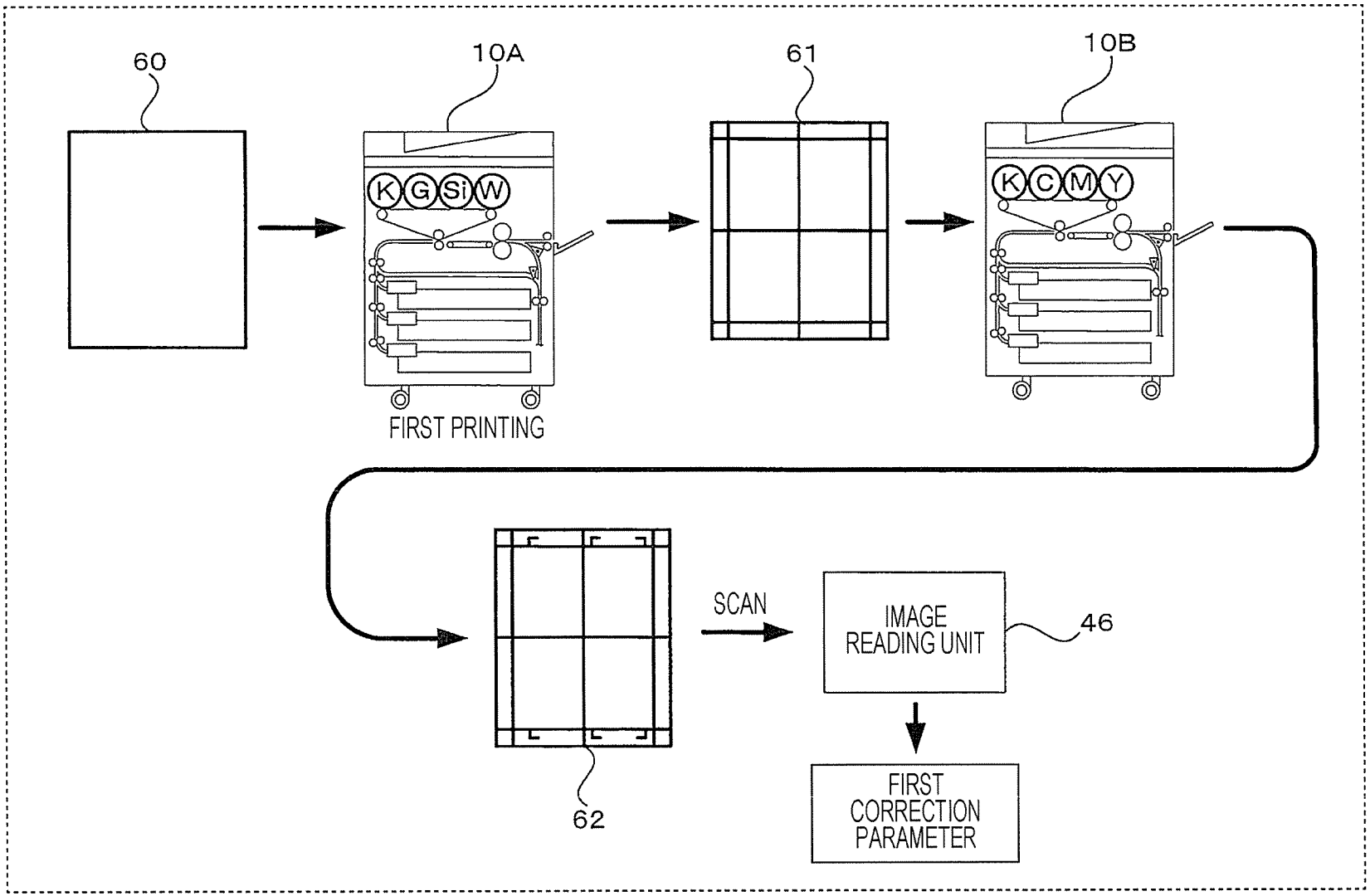
FIG. 10 illustrates a method for generating a first correction parameter in a case where first and second correction parameters are to be generated from different test charts.

First, a method for generating the first correction parameter will be described with reference to FIG. 10.

First, the image forming apparatus 10A prints the test image (first test image) shown in FIG. 9A onto a printing sheet 60 not having any images printed thereon.

Subsequently, the image forming apparatus 10B prints the test image (second test image) shown in FIG. 9B onto a printing sheet 61 having the first test image printed thereon.

A test chart 62 having these two test images printed thereon is read (scanned) by the image reading unit 46 of the image forming apparatus 10A, whereby the first correction parameter is generated.

Figure 11:
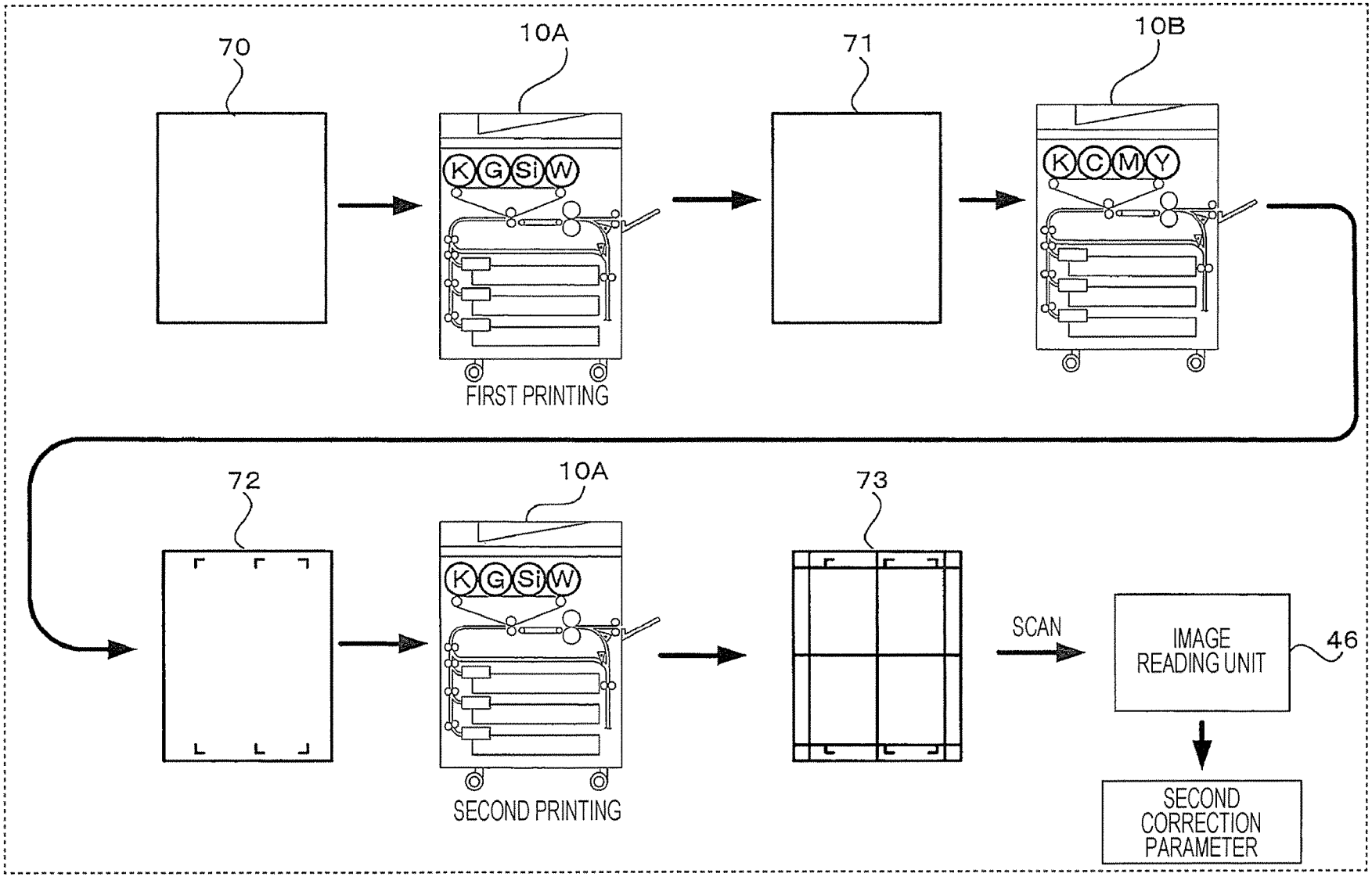
FIG. 11 illustrates a method for generating the second correction parameter in a case where the first and second correction parameters are to be generated from different test charts.

Next, a method for generating the second correction parameter will be described with reference to FIG. 11.

First, the image forming apparatus 10A prints an image not having print data onto a printing sheet 70 not having any images printed thereon. Specifically, although an image is not formed on the printing sheet 70, the printing sheet 70 is actually output after undergoing various types of processes, such as a charging process, an exposure process, a developing process, a transfer process, and a fixing process. In other words, although there is no change in appearance between a printing sheet 71 output after undergoing these various types of processes and the printing sheet 70 before the printing process, the sheets 71 and 70 have different sizes since the sheet 71 has moisture evaporated therefrom as a result of undergoing the fixing process.

Subsequently, the image forming apparatus 10B prints the test image (second test image) shown in FIG. 9B onto the printing sheet 71 that has undergone the first fixing process.

Then, the image forming apparatus 10A prints the test image (first test image) shown in FIG. 9A onto a printing sheet 72 having the second test image printed thereon.

Subsequently, a test chart 73 having the two test images printed thereon is read (scanned) by the image reading unit 46 of the image forming apparatus 10A, whereby the second correction parameter is generated.

A specific method for generating the first and second correction parameters from the test charts 62 and 73 will now be described with reference to FIG. 12.

Figure 12:
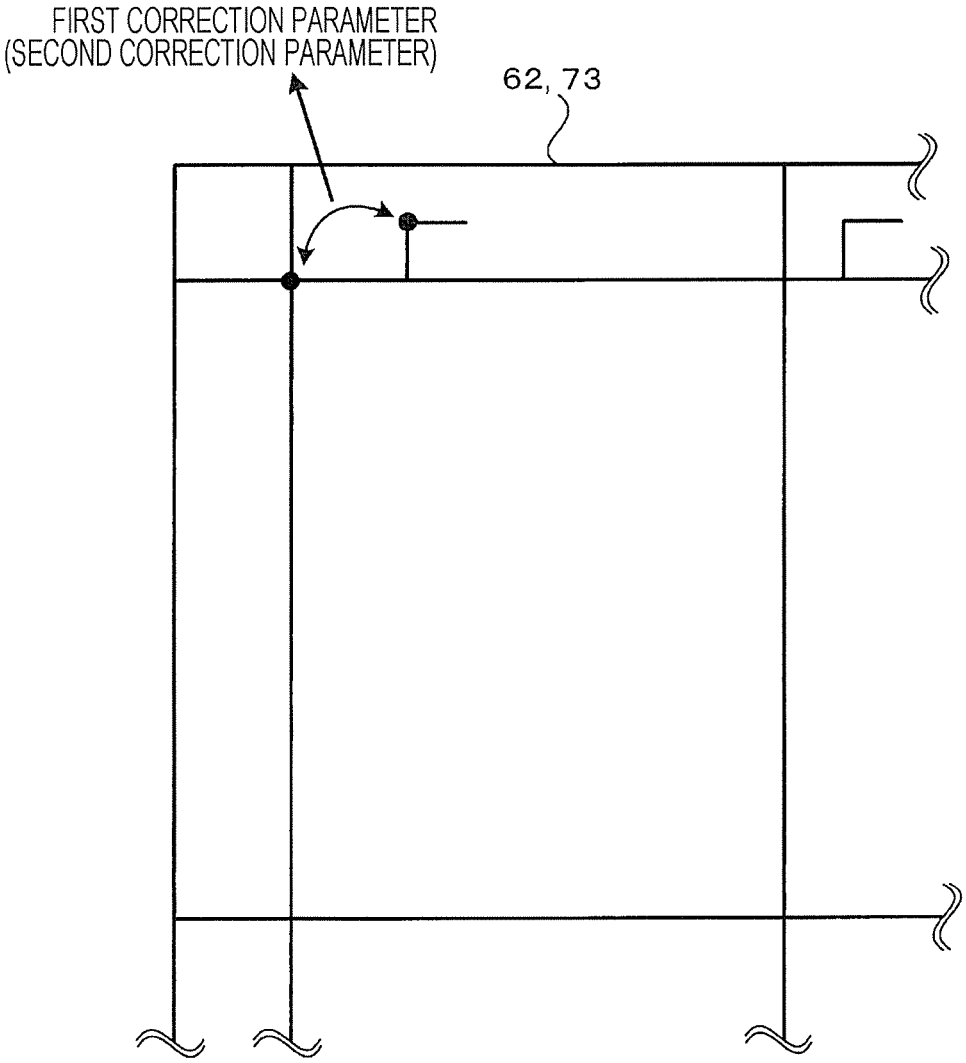
FIG. 12 illustrates a specific method for generating the first and second correction parameters from first and second test charts.

The print controller 41 of the image forming apparatus 10A extracts the positional relationship between the two test images shown in FIG. 12 from the images of the test charts read by the image reading unit 46 and generates the first and second correction parameters based on the extracted positional relationship. Specifically, if the position of a test image generated by the image forming apparatus 10A and the position of a test image generated by the image forming apparatus 10B is known in advance, correction parameters to be used for correcting the positional relationship between two images to be actually printed are generable by detecting a deviation in the positional relationship between actually-read test images. Although FIG. 12 corresponds to a case where a position in one test image is compared with a position in another test image, the correction parameters are actually generated by comparing multiple positions in test charts.

Then, the print controller 41 generates the first correction parameter from the test chart 62, generates the second correction parameter from the test chart 73, and causes the correction-parameter storage unit 42 to store the first and second correction parameters.

Figure 13:
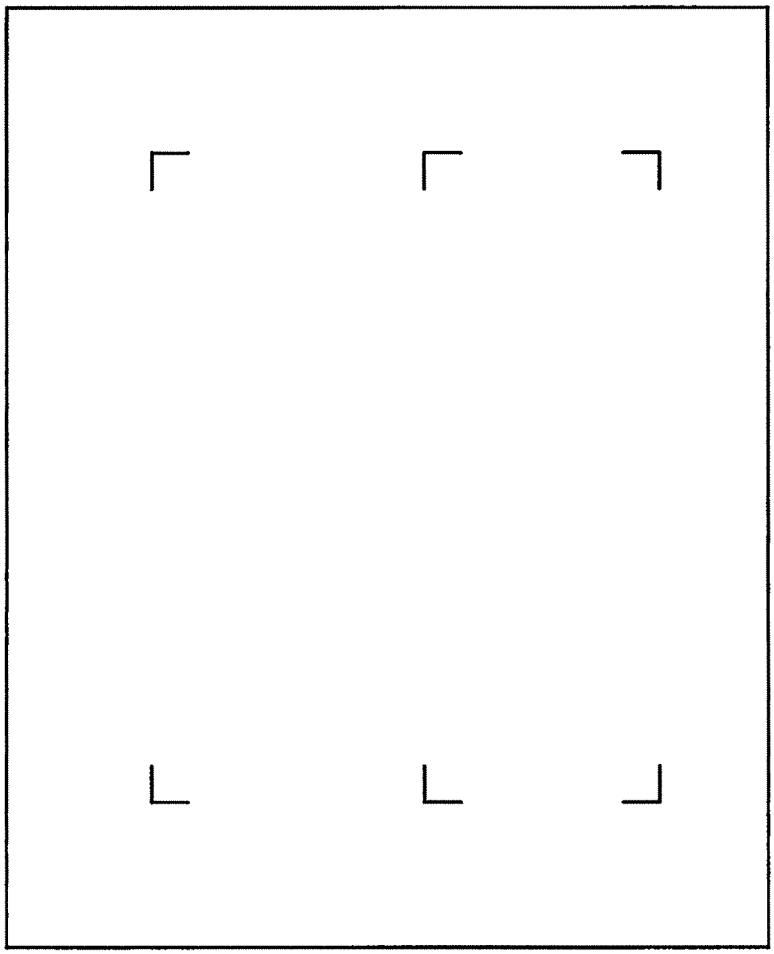
FIG. 13 illustrates a test image printed by the first image forming apparatus in a case where the first and second correction parameters are to be generated from a single test chart.
Figure 14:
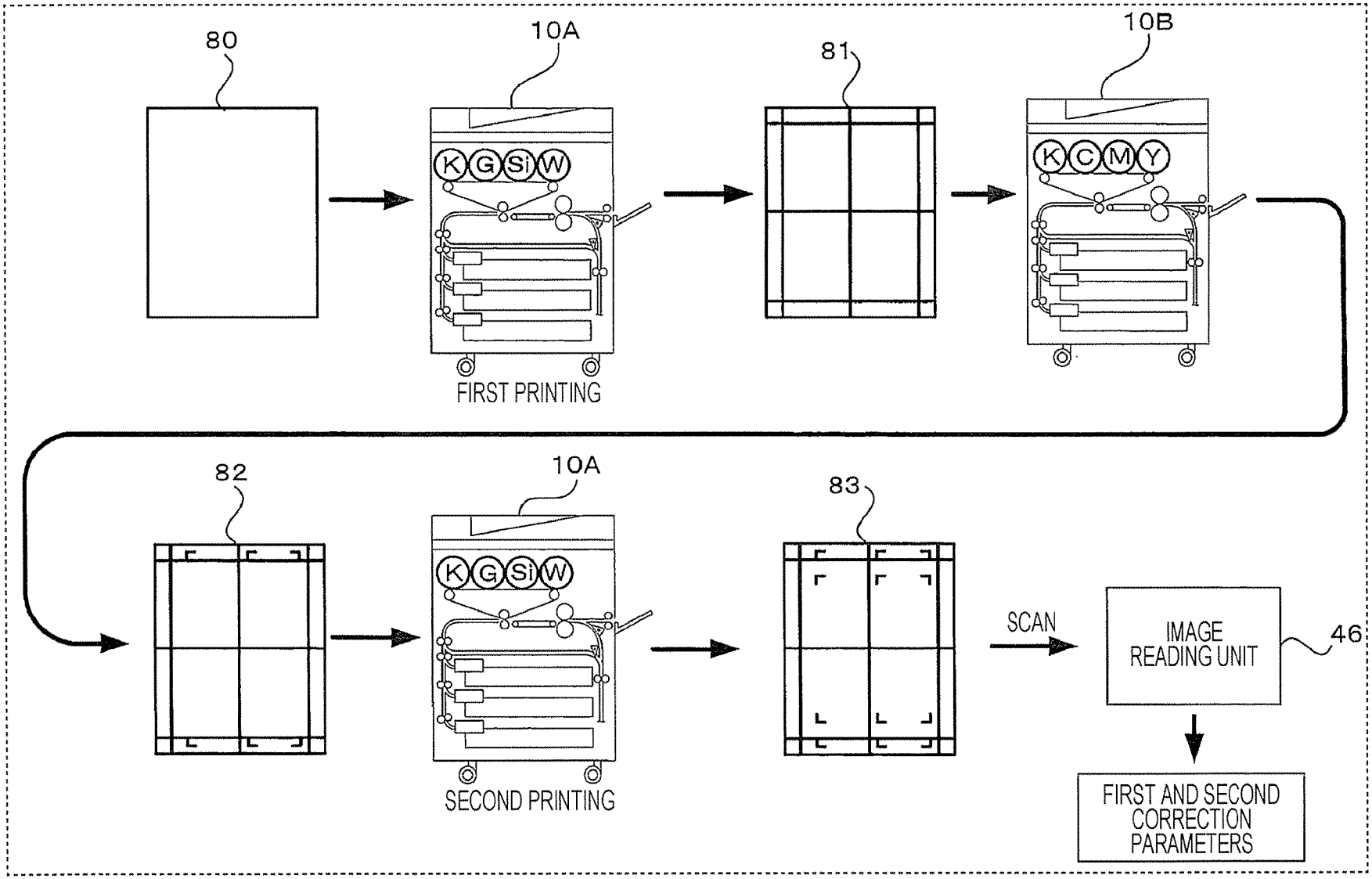
FIG. 14 illustrates a method for simultaneously generating the first and second correction parameters from the same test chart.
Figure 15:
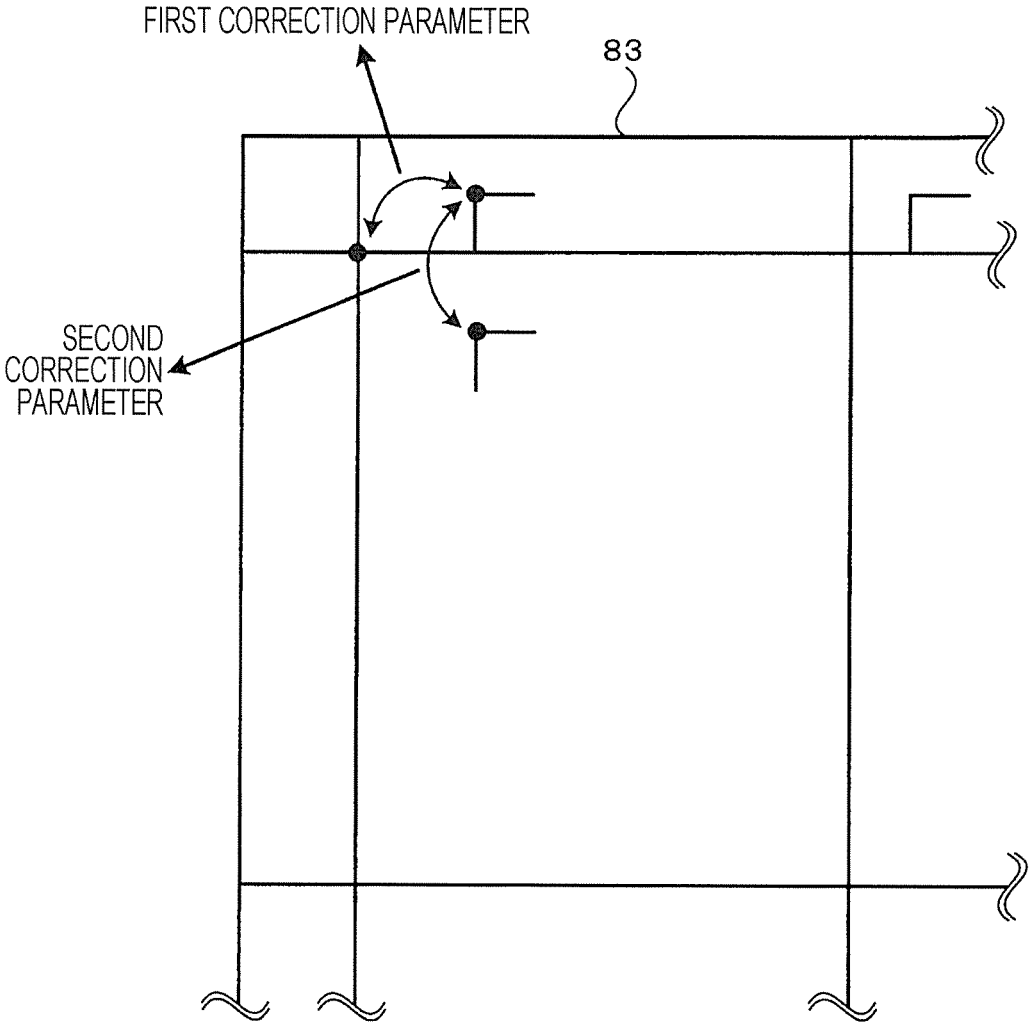
FIG. 15 illustrates a specific method for generating the first and second correction parameters from a test chart.

The following description with reference to FIGS. 13 to 15 relates to a case where the first and second correction parameters are generated from a single test chart.

In this case, the image forming apparatus 10A is capable of printing a test image shown in FIG. 13 in addition to the test image shown in FIG. 9A.

A method for simultaneously generating the first and second correction parameters from the same test chart will be described below with reference to FIG. 14.

First, the image forming apparatus 10A prints the test image (first test image) shown in FIG. 9A onto a printing sheet 80 not having any images printed thereon.

Subsequently, the image forming apparatus 10B prints the test image (second test image) shown in FIG. 9B onto a printing sheet 81 having the first test image printed thereon.

Then, the image forming apparatus 10A prints the test image (third test image) shown in FIG. 13 onto a printing sheet 82 having the aforementioned test images printed thereon.

Subsequently, a test chart 83 having the three test images printed thereon is read (scanned) by the image reading unit 46 of the image forming apparatus 10A, whereby the first and second correction parameters are generated.

A specific method for generating the first and second correction parameters from the test chart 83 will now be described with reference to FIG. 15.

With reference to the test image (second test image) printed by the image forming apparatus 10B in the image of the test chart 83 read by the image reading unit 46, the print controller 41 of the image forming apparatus 10A generates the first correction parameter based on the positional relationship with the test image (first test image) printed by the image forming apparatus 10A in the first printing step, and generates the second correction parameter based on the positional relationship with the test image (third test image) printed by the image forming apparatus 10A in the second printing step.

Finally, a specific operation method for selecting either one of the first and second correction parameters generated in accordance with the above-described method will be described with reference to FIG. 16.

Figure 16:
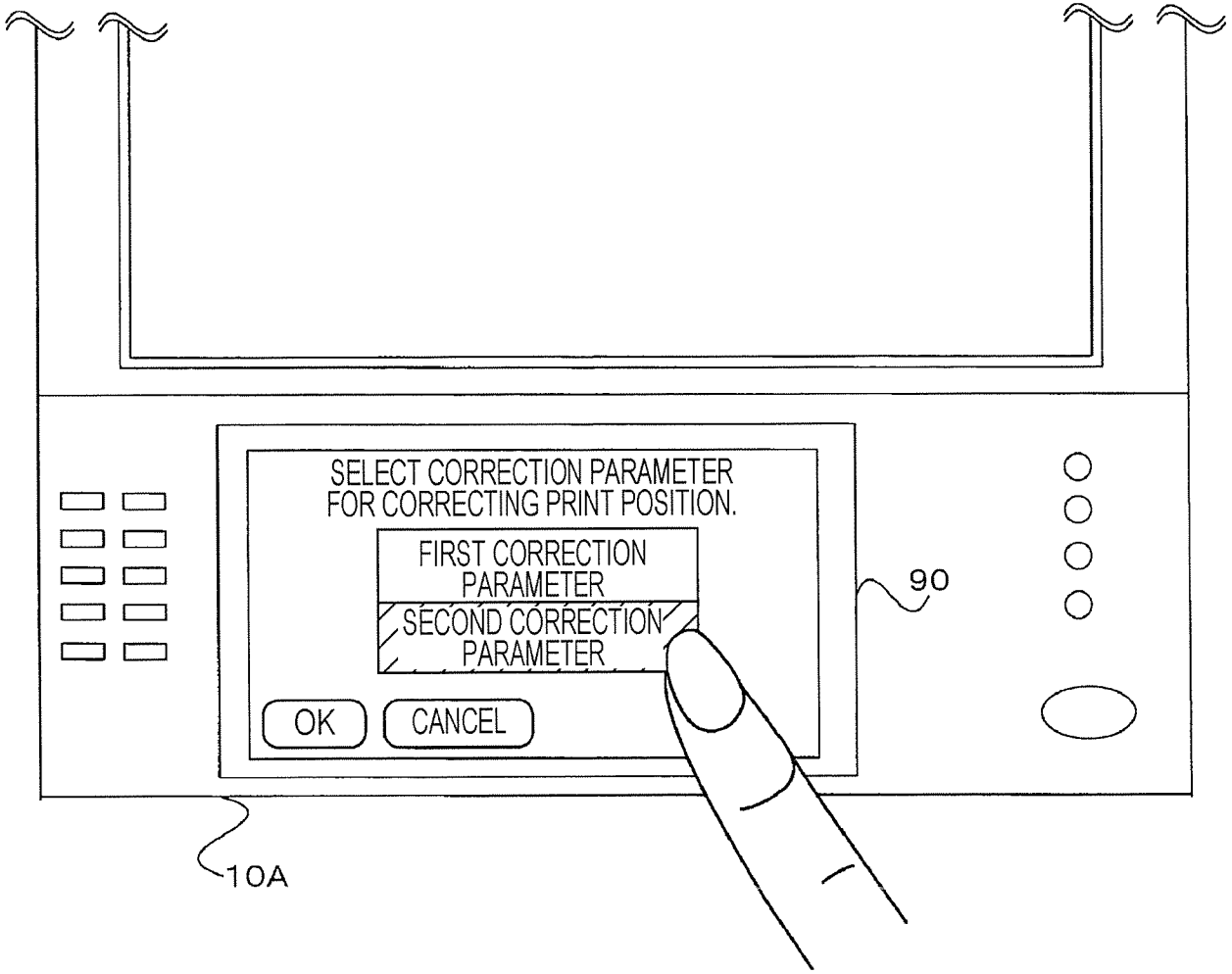
FIG. 16 illustrates a specific operation method for selecting either one of the first and second correction parameters.

For example, as shown in FIG. 16, the image forming apparatus 10A allows either one of the first and second correction parameters to be selectable on an operation panel 90.

Then, in a case where the printing process is to be performed three times by using the image forming apparatuses 10A and 10B in accordance with the printing method shown in FIG. 8, the first correction parameter is selected when the silver image 51 is to be formed onto the printing sheet 50 by the image forming apparatus 10A as a spot-color printer (first printing).

Subsequently, the second correction parameter is selected when the white (W) and gold (G) text images 53W and 53G are to be formed onto the printing sheet 50 having the YMCK image 52 formed thereon by using the image forming apparatus 10A as a spot-color printer (second printing).

Modifications

In the above exemplary embodiment, the three printing steps are sequentially performed on the same printing sheet by using the image forming apparatus 10A as a spot-color printer (first printing), the image forming apparatus 10B as a YMCK printer, and the image forming apparatus 10A as a spot-color printer (second printing) in that order. Alternatively, the exemplary embodiment of the present invention is similarly applicable to a case where the three printing steps are sequentially performed on the same printing sheet by using the image forming apparatus 10B as a YMCK printer (first printing), the image forming apparatus 10A as a spot-color printer, and the image forming apparatus 10B as a YMCK printer (second printing) in that order.

In this case, the first and second correction parameters may be stored in the image forming apparatus 10B so that a positional adjustment for reducing misregistration between the print positions of the two image forming apparatuses 10A and 10B may be performed in accordance with a procedure similar to that described above.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A first image forming apparatus comprising:

an image forming unit that forms an image onto a recording medium;

a memory that stores first correction information and second correction information, the first correction information being used for correcting misregistration between a print position in the first image forming apparatus and a print position in a second image forming apparatus when an image is formed by the first image forming apparatus and an image is subsequently formed by the second image forming apparatus, the second correction information being used for correcting misregistration between the print position in the second image forming apparatus and the print position in the first image forming apparatus when an image is formed by the first image forming apparatus, an image is subsequently formed by the second image forming apparatus, and then an image is formed by the first image forming apparatus; and a correcting unit that corrects a position where the image is to be formed by the image forming unit in accordance with either the first correction information or the second correction information stored in the memory.

2. The first image forming apparatus according to claim 1, wherein the first correction information is generated by using a test chart obtained by forming a first print-position-adjustment image onto the recording medium by using the first image forming apparatus and subsequently forming a second print-position-adjustment image onto the recording medium by using the second image forming apparatus, and wherein the second correction information is generated by using a test chart obtained by forming an image with no print data onto the recording medium by using the first image forming apparatus, forming the second print-position-adjustment image onto the recording medium by using the second image forming apparatus, and subsequently forming the first print-position-adjustment image or a third print-position-adjustment image onto the recording medium by using the first image forming apparatus.

3. The first image forming apparatus according to claim 2, wherein, when the image with no print data is to be formed onto the recording medium, a fixing process is performed without forming an image onto the recording medium.

4. The first image forming apparatus according to claim 1, wherein the first correction information and the second correction information are generated by using a test chart obtained by forming a first print-position-adjustment image onto the recording medium by using the first image forming apparatus, forming a second print-position-adjustment image onto the recording medium by using the second image forming apparatus, and subsequently forming a third print-position-adjustment image onto the recording medium by using the first image forming apparatus.

5. The first image forming apparatus according to claim 4, further comprising:

a generating unit that generates the first correction information from a positional relationship between the first print-position-adjustment image and the second print-position-adjustment image on the recording medium and that generates the second correction information from a positional relationship between the second print-position-adjustment image and the third print-position-adjustment image on the recording medium.

6. The first image forming apparatus according to claim 1, further comprising:

a receiving unit that receives selected correction information to be used when the image forming unit forms the image onto the recording medium, wherein the correcting unit corrects the position where the image is to be formed by the image forming unit in accordance with a selected one of the first correction information and the second correction information received by the receiving unit.

7. The first image forming apparatus according to claim 1, wherein the image forming unit is capable of forming an image of a spot color other than a process color onto the recording medium.

8. The first image forming apparatus according to claim 7, wherein the image forming unit is capable of forming an image of the process color onto the recording medium, and forms a print-position-adjustment image of the process color in a case where a print-position-adjustment image is to be formed on the recording medium.

9. The first image forming apparatus according to claim 7, wherein the process color includes yellow, magenta, cyan, and black colors, and the spot color includes a color other than the yellow, magenta, cyan, and black colors.

10. A non-transitory computer readable medium storing a program causing a computer to execute a process, the process comprising:

receiving selected correction information to be used when an image is to be formed onto a recording medium; and correcting a position where the image is to be formed onto the recording medium in accordance with the selected correction information received in the receiving, the selected correction information being one of first correction information and second correction information, the first correction information being used for correcting misregistration between a print position in a first image forming apparatus and a print position in a second image forming apparatus when an image is formed by the first image forming apparatus and an image is subsequently formed by the second image forming apparatus, the second correction information being used for correcting misregistration between the print position in the second image forming apparatus and the print position in the first image forming apparatus when an image is formed by the first image forming apparatus, an image is subsequently formed by the second image forming apparatus, and then an image is formed by the first image forming apparatus.

11. A test chart obtained by forming a first print-position-adjustment image, a second print-position-adjustment image, and a third print-position-adjustment image onto a recording medium, the first print-position-adjustment image being formed by a first image forming apparatus, the second print-position-adjustment image being formed by a second image forming apparatus after the first print-position-adjustment image is formed, the third print-position-adjustment image being formed by the first image forming apparatus after the second print-position-adjustment image is formed.

* * * * *